US012637621B2

(12) United States Patent
Hatzenbuehler

(10) Patent No.: US 12,637,621 B2
(45) Date of Patent: May 26, 2026

(54) CLOSED, GASTIGHT SYSTEM AND METHOD FOR GAINING SELLABLE PETROLEUM COKE PIECES OUT OF SOLIDIFIED PETROLEUM COKE IN A COKE DRUM UNIT

(71) Applicant: ART-Envi Services GmbH & Co. KG, Karlsruhe (DE)

(72) Inventor: Rainer Hatzenbuehler, Karlsruhe (DE)

(73) Assignee: ART-Envi Services GmbH & Co. KG, Karlsruhe (DE)

( * ) Notice: Subject to any disclaimer, the term of this patent is extended or adjusted under 35 U.S.C. 154(b) by 253 days.

(21) Appl. No.: 18/412,115

(22) Filed: Jan. 12, 2024

(65) Prior Publication Data

US 2025/0230363 A1 Jul. 17, 2025

(51) Int. Cl.
*C10B 33/14* (2006.01)
*C10B 27/02* (2006.01)
(Continued)

(52) U.S. Cl.
CPC ..... *C10B 57/005* (2013.01); *C10B 27/02* (2013.01); *C10B 33/14* (2013.01); *C10B 39/10* (2013.01); *C10B 39/16* (2013.01); *C10B 57/10* (2013.01)

(58) Field of Classification Search
CPC ..... C10B 27/02; C10B 33/003; C10B 33/14; C10B 39/04; C10B 39/10; C10B 39/16;
(Continued)

(56) References Cited

U.S. PATENT DOCUMENTS

2007/0262032 A1* 11/2007 Wang ..... C10B 39/06 210/767

FOREIGN PATENT DOCUMENTS

| | | | |
|---|---|---|---|
| CN | 106398743 A | 2/2017 | |
| EP | 2707458 B1 | 9/2015 | |
| WO | WO-2018001462 A1 * | 1/2018 | ..... C10B 25/10 |

OTHER PUBLICATIONS

English Language Translation of CN106398743A.
(Continued)

*Primary Examiner* — Ellen M Mcavoy
*Assistant Examiner* — Chantel Graham
(74) *Attorney, Agent, or Firm* — William J. Barber; WARE FRESSOLA MAGUIRE & BARBER LLP

(57) ABSTRACT

A closed, gastight system for gaining sellable petroleum coke pieces out of solidified petroleum coke in a coke drum unit, wherein the system is configured to be connected to a coke drum unit (X) containing solidified petroleum coke and comprises a coke crushing unit (C) for crushing the petroleum coke into sellable petroleum coke pieces, configured to be connected to the coke drum unit (X), particularly by means of a flexible transition piece (A);

a closed sluice way (D) leading petroleum coke slurry to a closed slurry basin;

a closed slurry basin (E);

a dewatering bin unit (G) configured to receive the petroleum coke slurry from the slurry basin (E), to collect the sellable petroleum coke pieces, and to act as a filter leading runoff drain water from a lower area thereof as filtered water and petroleum coke fines out of it;

(Continued)

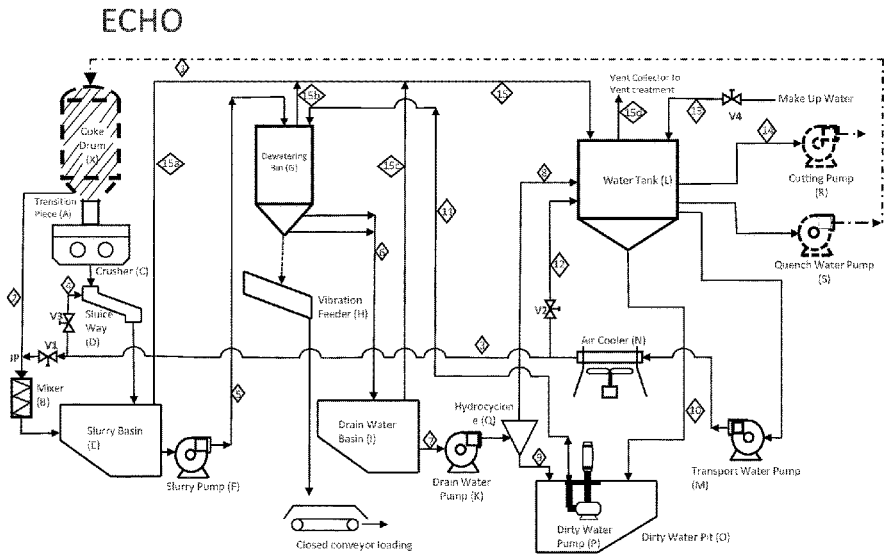

a closed drain water basin (I), separate from the slurry basin (E), configured to receive the filtered water and the petroleum coke fines from the dewatering bin unit (G);

a water tank (L) configured to receive the filtered water from the drain water basin (I);

a hot quench water draining line (2) configured to receive hot quench water from the coke drum unit (X) and to lead the same to the closed slurry basin (E); and characterised:

in that the water tank (L) is configured as single water tank (L) without a separate second tank; and by comprising one or more of the following elements:

a first vent collection line (15*a*) extending from a top portion of the closed slurry basin (E) to the clean water tank (L), particularly a top portion thereof, for collecting excess amounts of gaseous phase from the slurry basin (E) and for feeding the same to the clean water tank (L);

a second vent collection line (15*b*) extending from the dewatering bin unit (G), particularly a top portion thereof, to the clean water tank (L), particularly a top portion thereof, for collecting excess amounts of gaseous phase from the dewatering bin unit (G) and for feeding the same to the clean water tank (L); and a third vent collection line (15*c*) extending from the closed drain water basin (I), particularly a top portion thereof, to the clean water tank (L), particularly a top portion thereof, for collecting excess amounts of gaseous phase from the closed drain water basin (I) and for feeding the same to the clean water tank (L);

and by comprising a fourth vent collection line (15*d*) extending from the water tank (L), particularly a top portion thereof, to a vent treatment unit, in particular to a vent incineration unit.

20 Claims, 1 Drawing Sheet

(51) Int. Cl.

| | |
|---|---|
| ***C10B 39/10*** | (2006.01) |
| ***C10B 39/16*** | (2006.01) |
| ***C10B 57/00*** | (2006.01) |
| ***C10B 57/10*** | (2006.01) |

(58) Field of Classification Search

CPC ..... C10B 55/00; C10B 57/005; C10B 57/10; H01L 2224/32225; H01L 2224/83192; H01L 24/83

See application file for complete search history.

(56) References Cited

OTHER PUBLICATIONS

N.N.: "Trust our KREBS Cyclone Close Packed", Jan. 1, 2021, XP055982546, Retrieved from the Internet: URL: https://www.flsmidth.com/-/media/brochures/brochures-products/centrifugation-and-classification/2021/krebs-cp-vessels-for-oil-refinery-applications.pdf, (retrieved on Nov. 17, 2022), [A] 1-15 * figure . *.

* cited by examiner

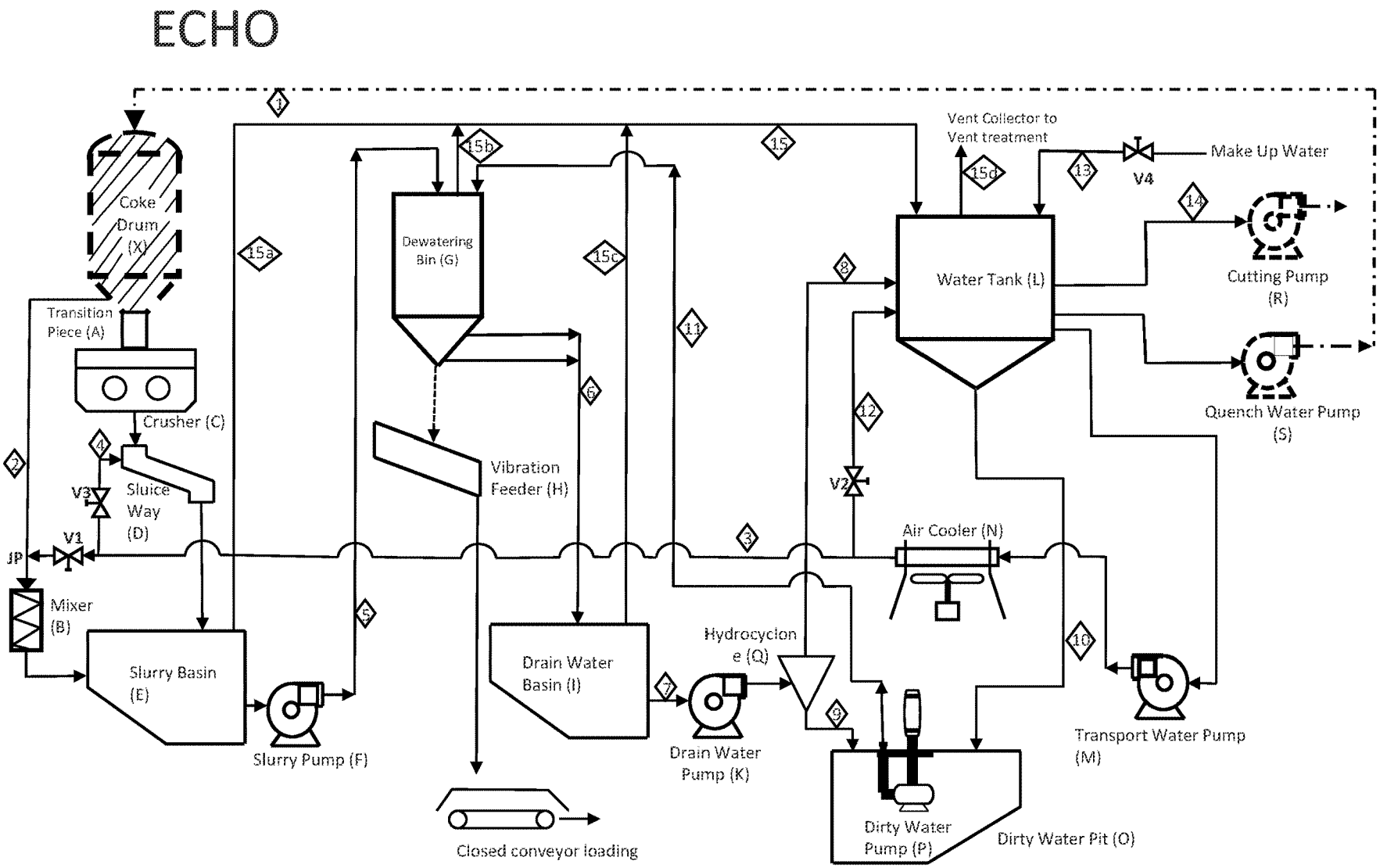
ECHO
Coke Drum (X)
Transition Piece (A)
Crusher (C)
Sluice Way (D)
Mixer (B)
Slurry Basin (E)
Slurry Pump (F)
Dewatering Bin (G)
Vibration Feeder (H)
Drain Water Basin (I)
Closed conveyor loading
Drain Water Pump (K)
Hydrocyclone (Q)
Dirty Water Pump (P)
Dirty Water Pit (O)
Transport Water Pump (M)
Air Cooler (N)
Water Tank (L)
Vent Collector to Vent treatment
Make Up Water
Cutting Pump (R)
Quench Water Pump (S)
V1
V2
V3
V4
JP
1
2
3
4
5
6
7
8
9
10
11
12
13
14
15
15a
15b
15c
15d

CLOSED, GASTIGHT SYSTEM AND METHOD FOR GAINING SELLABLE PETROLEUM COKE PIECES OUT OF SOLIDIFIED PETROLEUM COKE IN A COKE DRUM UNIT

The invention relates to a closed, gastight system for gaining sellable petroleum coke pieces out of solidify petroleum coke in a coke drum unit and to a method for gaining sellable petroleum coke piece out of solidified petroleum coke in a coke drum unit. This system and method can also be called environmental coke handling operation, or ECHO.

EP 2 707 458 B1 discloses a closed coke slurry system and a method for gaining sellable petroleum coke pieces out of solidified petroleum coke in a coke drum unit. This system is, however, not emission-free since still a substantial amount of steam and coke fines is released into the environment during operation of the system. Furthermore, there is a need for further cost reduction.

WO 2018/001462 A1 discloses an arrangement of a coke drum unit and of a coke crushing unit for use in a closed, gas-tight system for gaining sellable petroleum coke pieces out of solidified petroleum coke in a coke drum unit comprising the features of the preamble of independent claim 1.

From US 2007/262032 A1, a method for treating coke-cooling wastewater, comprising the following steps is known:

(a) cooling the coke-cooling wastewater produced in a delayed coking process to 5-55° C. under 0.1-0.25 MPa absolute pressure, to obtain cooled coke-cooling wastewater, (b) subjecting the cooled coke-cooling wastewater to solid-liquid separation, to obtain a coke breeze phase and a liquid phase;

(c) further separating the obtained liquid phase, to obtain an oil phase and a water phase; and (d) further discharging water from the obtained oil phase, to obtain the separated oil phase.

It is therefore an object of the present invention to provide a system and a method which is virtually free of any steam and coke fine emissions into the environment, and which reduces the installation and operation cost.

This object is solved completely by the subject matter of appended independent claim 1. Advantageous embodiments are defined in the dependent claims.

According to an embodiment of the invention which is not covered by the appended claims, a closed, gastight system for gaining sellable petroleum coke pieces out of solidified petroleum coke in a coke drum unit is provided which is configured to be connected to a coke drum unit containing solidified petroleum coke and which comprises

- a coke crushing unit for crushing the petroleum coke into sellable petroleum coke pieces, configured to be connected to a coke drum unit, particularly by means of a flexible transition piece;
- a line, particularly a closed sluice way leading petroleum coke slurry to a closed slurry basin;
- a closed slurry basin;
- a dewatering bin unit configured to receive the petroleum coke slurry from the slurry basin, to collect the sellable petroleum coke pieces, and to act as a filter leading runoff drain water from a lower area thereof as filtered water and petroleum coke fines out of it;
- a closed drain water basin, separate from the slurry basin, configured to receive the filtered water and the petroleum coke fines from the dewatering bin unit;

- a single water tank configured to receive the filtered water from the drain water basin;
- a hot quench water draining line configured to receive hot quench water from the coke drum unit and to lead the same to the closed slurry basin (E); and
- a cooling water line leading from the water tank, particularly from a intermediate portion thereof, to the hot quench water draining line, in particular to a joining point in the hot quench water draining line at a position above the closed slurry basin, configured to feed cooling water from the water tank to the hot water in the hot quench water draining line, in order to prevent steam generation within the slurry basin.

The inventors of the present invention have discovered that a substantive amount of steam and coke fines are discharged into the atmosphere in the conventional coke slurry system of EP 2 707 458 B1 since the water including coke fines which is discharged from the coke drum into the slurry basin during or after the quenching operation evaporates in the slurry basin and has to be discharged to the environment via one or more vents.

The inventors have further discovered that in the coke drum the solidified or solidifying coke has a temperature of up to 550° C. at the beginning of the quenching operation, that the quenching water which is fed into the coke drum stands up to 60 meter high in the coke drum, that the pressure of this quenching water is increased up to 6 bar and it heats up to a temperature of up to 165° C. However, since the coke drum, the coke crushing unit and the hot water draining line leading from the coke drum unit to the closed slurry basin form a closed system, this quenching water does not evaporate before it enters into the slurry basin.

Therefore, the inventors have identified the need of effectively cooling this quenching water, which also includes coke fines, to a temperature of well below 100° C. at atmosphere level before it can enter the slurry basin.

According to the above embodiment of the invention this is achieved by providing a cooling water line leading from the water tank, particularly from a intermediate portion thereof, to the hot quench water draining line, in particular to a joining point in the hot quench water draining line at a position above the closed slurry basin, which feeds cooling water from the water tank to the hot water in the hot quench water draining line, in order to prevent steam generation within the slurry basin.

By this measure, steam generation within the closed slurry basin is reliably prevented and the emission of water and even more importantly of coke fines and volatile organic compound VOC to the atmosphere is reliably avoided. Hydrocarbon vapor exhaust is reliably prevented by such effective cooling and steam generation prevention measures.

By the cooling water line, the amount of cooling water needed to cool down the hot quench water can be individually adapted to the respective needs.

By the system according to the above embodiment of the invention, the solidified coke within the coke drum unit can be cooled down effectively.

Furthermore, the cooling water line downstream of the joining point is subject to lower pressure levels which avoids damages and makes it possible to use piping of less material strength which also contributes to reducing the cost.

Moreover, due to the significant temperature and pressure reduction already within the hot quench water draining line the fire hazard is minimized.

According to an embodiment of the invention, the system according to the present invention is configured to be connected to a coke drum unit, which coke drum unit is not part of the system. Accordingly, the coke crushing unit for crushing the petroleum coke into sellable petroleum coke pieces is configured to be connected to the coke drum unit, particularly by means of a flexible transition piece, the hot quench water line is configured to be connected to the coke drum unit, particularly to a bottom portion thereof. In addition, a quench water line can be provided which is configured to be connected to the coke drum unit.

According to another embodiment of the system, the coke drum unit is part of the system.

According to an embodiment of the invention, the slurry basin is configured as closed, emission-free slurry basin, which does not discharge to the environment.

According to a further embodiment, the drain water basin is configured as closed, emission-free drain water basin, which does not discharge to the environment.

According to a further embodiment, a mixing unit, in particular a static mixer, is provided in the hot quench water draining line, in particular at the position of the joining point of the cooling water line, or at a position downstream of the joining point of the cooling water line, but upstream of the inlet of the closed slurry basin.

The mixing unit is particularly configured to mix the cooling water in-line to the hot quench water being supplied from the coke drum unit through the hot quench water draining line.

By such mixing unit, the water flow of the cooling water which is added to the hot drain water flow and/or the resulting flow of the cooled down quench water downstream of the mixing unit can be controlled effectively. By such flow control, also the temperature of the resulting flow of the cooled down quench water downstream of the mixing unit can be controlled very effectively. Thus, a precise temperature and pressure control can be achieved.

The mixing unit can particularly be configured to adapt the flow rate of the cooling water coming from the cooling water line to achieve a desired target temperature of the cooled down quench water exiting the mixing unit.

According to a further embodiment, a heat rejection heat exchanger is provided in the cooling water line, which is configured to reduce the temperature of the cooling water flowing through the cooling water line, against a secondary heat exchange medium, particularly environmental air.

By such heat rejection heat exchanger, the temperature of the cooling water and, thus, the efficiency of the cooling of the hot quench water flowing through the hot quench water draining line can be improved significantly. This make it possible to reduce the amount of the cooling water flow which is mixed to the hot quench water flow. Such heat rejection heat exchanger can enable a continuous cooling of the cooling water flowing through the cooling water line. Such heat rejection heat exchanger can particularly be configured as an air cooler.

According to a further embodiment, a transport water pump is provided in the cooling water line, particularly at a position upstream of the heat rejection heat exchanger. Such transport water pump guarantees for a stable cooling operation.

According to a further embodiment, the system further comprises a quench water line leading from the single water tank to the coke drum unit, for filling the coke drum unit with water, thereby hardening and cooling the solidified petroleum coke. In particular, a quench water pump can be provided in the quench water line.

According to a further embodiment, the system further comprises a control unit. During operation of the system, the solidified petroleum coke is at a temperature of up to 550° C., and the water in the single water tank and flowing into the cooling water line is at a temperature of 60 to 80° C.

The control unit can be configured to supply quench water to the coke drum unit through the quench water line, which heats up in the coke drum unit to a temperature of up to 165° C., such that the water stands up to 60 m high within the coke drum unit and has a pressure level of up to 6 bar, without evaporating.

The control unit can be further configured to operate the transport water pump and the heat rejection heat exchanger such that a cooling water flow mixes with the hot water in the hot quench water draining line, such that the temperature of the hot drain water is reduced to a temperature of around 85-95° C. before reaching the slurry basin.

This embodiment provides for a particularly effective control and reliably prevents steam generation within the slurry basin.

At the beginning of the quenching operation/quenching step/quenching cycle, particularly when quench water is fed to the coke drum from the water tank through the quench water line, the solidified petroleum coke within the coke drum is at a temperature of up to 550° C. During this quenching operation, the quench water which is at a temperature of around 70° C. in the water tank is used to quench the solidified coke drum, which heats up to temperatures of up to 165° C. against the hot solidified coke, and in turn the temperature of the solidified petroleum coke is reduced accordingly.

At the end of the quenching operation, the temperature of the solidified petroleum coke can be reduced to temperatures of around 100° C. In the quenching operation, the coke drum can be repeatedly flooded with quench water from the water tank and emptied from this water, which hardens and cools the coke and the coke drum. After the quenching operation, the upper and lower coke drum heads can be opened in order to allow for the coke chunks to get out of the coke drum.

According to a further embodiment, the control unit is further configured to operate the heat rejection heat exchanger in the cooling water line, such that the temperature of the cooling water flowing through the cooling water line is cooled against a secondary heat exchange medium, particularly environmental air, to a temperature of around 50 to 70° C. By this embodiment, a particularly effective cooling of the hot quench water flowing through the hot quench water draining line is attained.

According to a further embodiment, a drain water discharge line is provided connecting the closed drain water pit to the water tank.

According to a further embodiment, a drain water pump and a centrifugal separation device, in particular a hydrocyclone device, for separating slurry particles out of the drain water from the drain water basin is provided in the drain water discharge line.

According to a further embodiment, a dirty water pit, separate from the drain water basin and separate from the slurry basin, is provided, which is configured to receive the slurry particles separated by the centrifugal separation device.

According to a further embodiment, a dirty water supply line is provided, leading from the dirty water pit to the dewatering bin.

According to a further embodiment, a dirty water pump is provided at or in the dirty water pit, or in the dirty water supply line.

The water together with the coke fines get into the drain water basin from the dewatering bin. From the drain water basin, a drain water pump pumps the water together with the petroleum coke fines into the direction of the water tank through the drain water discharge line.

A centrifugal separation device, in particular a hydrocyclone device, separates the slurry particles and coke fines out of the drain water from the drain water basin and routes them to a separate dedicated dirty water pit, which is separate from the drain water basin and separate from the slurry basin. This dirty water pit receives the slurry particles and petroleum coke fines which have been separated from the drain water by the centrifugal separation device.

The drain water from which the slurry particles and petroleum coke fines have been separated in the centrifugal separation device is led through the clean water supply line to the water tank.

This embodiment/these embodiments provide(s) for a effective removal of petroleum coke fines out of the water downstream of the drain water basin, for an effective and reliable separation of slurry particles and petroleum coke fines out of the drain water, and for making this drain water usable for further purposes, especially for the use as quench water, as cutting water and as transport water for the closed coke slurry system.

Such centrifugal separation device, in particular such hydrocyclone, can further improve the separation of solids, and can further speed up the whole process.

The provision of such centrifugal separation device and such dirty water pit eliminate the need of a separate water tank, like a water settling tank, which contributes to reducing the total cost of the system.

The dirty water including the slurry particles and the petroleum coke fines that have been separated from the drain water through the centrifugal separation device and which is collected in the dirty water pit can be fed back into the dewatering bin by a separate dirty water supply line and a dirty water pump. The slush comprising these separated slurry particles and petroleum coke fines is pumped through the dirty water supply line, by the dirty water pump to the dewatering bin unit, where they are trapped in the coke filter bed and are effectively removed from the process.

According to a further embodiment, the single water tank comprises a sedimentation stage configured to separate solid particles at its bottom portion, particularly at its low point.

According to a further embodiment, a solid particle discharge line is provided connecting the single water tank, particularly its bottom portion to the dirty water pit.

According to the invention, the single water tank is configured a single water tank without a separate second tank. Thus, a significant footprint reduction of the system according to the present invention in comparison to conventional coke handling systems is achieved.

The water tank serves as the water inventory for the whole process. The sedimentation stage of the single water tank separates solid particles at the bottom portion, particularly at the low point of the single water tank. The bottom portion, particularly the low point can be drained to the dirty water pit as needed, particularly in regular intervals. This two stage drain water purification, the first stage being the centrifugal separation device and the second stage being the sedimentation stage of the water tank, allows for a particularly effective purification of the drain water from the drain water basin.

According to a further embodiment, a slurry line is provided connecting the slurry basin to the dewatering bin unit, in particular to a top portion thereof, for pumping petroleum coke slurry to the dewatering bin unit. A slurry pump can be provided in the slurry line.

According to a further embodiment, a flushing line branches off from the cooling water line and leads to the sluice way, for supporting flushing and pumping of the petroleum coke slurry to the slurry basin. A valve can be provided in this flushing line.

By such flushing line, the flushing and pumping of the petroleum coke slurry from the outlet of the coke crushers through the sluice way can be supported effectively.

By providing a valve in this flushing line, this flushing line can be opened and supplied with cooling water/transport water from the cooling water line, as needed and this line can be closed, if no petroleum coke slurry is to be transported to the slurry basin.

According to a further embodiment, a dirty water supply line/sludge line is provided leading from the dirty water pit to the dewatering bin unit. A dirty water pump can be provided in the sludge line.

According to the invention, the system comprises at least one of the first three, and the fourth of the following elements:

- a first vent collection line extending from a top portion of the closed slurry basin to the clean water tank, particularly a top portion thereof, for collecting excess amounts of gaseous phase from the slurry basin and for feeding the same to the clean water tank; and/or
- a second vent collection line extending from the dewatering bin unit, particularly a top portion thereof, to the clean water tank, particularly a top portion thereof, for collecting excess amounts of gaseous phase from the dewatering bin unit and for feeding the same to the clean water tank; and/or
- a third vent collection line extending from the closed drain water basin, particularly a top portion thereof, to the clean water tank, particularly a top portion thereof, for collecting excess amounts of gaseous phase from the closed drain water basin and for feeding the same to the clean water tank; and
- a fourth vent collection line extending from the water tank, particularly a top portion thereof, to a vent treatment unit, in particular to a vent incineration unit.

By these vent collection lines it is reliably avoided that gaseous phase/steam containing coke particles gets into the environment. Rather the gaseous phase/the steam which typically contains coke particles, is collected from this slurry basin/from the dewatering bin unit/from the drain water basin and fed to the clean water tank. From the clean water tank, the gaseous phase of the water/the steam which typically contains coke particles which collects therein is not released into the environment via one or more vents, which is the case for other systems, but rather is fed to a vent treatment unit, for example a vent incineration unit.

The invention also relates to a method for gaining sellable petroleum coke pieces out of solidified petroleum coke in a coke drum unit, using the system of any of claims 3 to 11, comprising the steps of

- in a quenching and quench water cooling operation, flooding the coke drum unit, by means of a quench water supply line leading from a single water tank to the coke drum unit, and draining the hot quench water to a slurry basin via a hot quench water line, thereby hardening and cooling the solidified petroleum coke;
- wherein a cooling water flow is fed from a water tank, particularly from a bottom portion thereof, through a cooling water line to the hot quench water draining line, in particular to a joining point in the hot quench water draining line at a position above the slurry basin, in order to cool the hot water in the hot quench water draining line, in order to prevent steam generation within the slurry basin.

The advantages and embodiments of the system also apply to this method and they are not repeated here for brevity.

The quenching and quench water cooling operation can be repeated as often as needed. For this purpose the coke drum can be closed at its bottom portion, for example at its transition piece which can be located between the coke drum unit and the coke crushing unit.

Quench water can be supplied from the water tank through the quench water supply line until there is enough quench water standing within the coke drum unit. Thereafter the coke drum can be opened at its bottom portion, the hot quench water flowing through the hot quench water draining line is effectively cooled by the cooling water flow from the water tank within the hot quench water draining line and before it reaches the slurry basin, in order to prevent steam generation within the slurry basin. This can be repeated as often as needed, particularly until the solidified coke within the coke drum unit has been cooled down to a target value, e.g. of about 100° C.

According to a first embodiment of this method, during operation of the system, the water in the single water tank and flowing into the cooling water line is at a temperature of around 70° C.; and during beginning of the quenching and quench water cooling operation, the solidified petroleum coke is at a temperature of up to 550° C.

In the flooding step, quench water can be supplied to the coke drum unit through the quench water line, where the water stands up to 60 m high within the coke drum unit, such that it heats up to a temperature of up to 165° C., and has a pressure level of up to 6 bar, without evaporating.

In the draining step, the transport water pump and, particularly also the heat rejection heat exchanger can be operated such that the cooling water flow mixes with the hot water in the hot quench water draining line, such that the temperature of the hot drain water is reduced to a temperature of around 85-95° C. in the hot quench water draining line before reaching the slurry basin.

In the draining step, the heat rejection heat exchanger in the cooling water line can be operated, such that the temperature of the cooling water flowing through the cooling water line is cooled against a secondary heat exchange medium, particularly environmental air, to a temperature of around 50 to 70° C.

This provides for a particularly effective control.

The invention also relates to a method for gaining sellable petroleum coke pieces out of solidified petroleum coke in a coke drum unit, using the system of any of claims 9 to 11, comprising a water treatment operation, comprising

- leading drain water from the closed drain water basin to the water tank through a drain water discharge line connecting the closed drain water basin to the single water tank, particularly to an upper portion thereof, and using a drain water pump;
- separating slurry particles out of the drain water from the drain water basin using a centrifugal separation device, in particular a hydrocyclone device, in the drain water discharge line;
- receiving the slurry particles separated by the centrifugal separation device in a dirty water pit, separate from the drain water basin and separate from the slurry basin;
- leading dirty water from the dirty water pit to the dewatering bin unit, through a dirty water supply line, using a dirty water pump provided at or in the dirty water pit, or in the dirty water supply line.

The solid particles are separated at the bottom portion, at the low point of the single water tank.

The solid particles are drained from the bottom portion, particularly the low point of the single water tank, through a solid particle discharge line to the dirty water pit, wherein the solid particle discharge line connects the single water tank, particularly its bottom portion to the dirty water pit.

By this embodiment, a particularly effective and comparably cheap purification of the drain water within the drain water basin is achieved, and the need for a second tank, for example a water settling tank in addition to the single water tank is eliminated. The amount of water which has to be added to the system, for example as make up water to be supplied to the water tank is significantly reduced by the high performance water separation according to the present invention, which helps saving water and reduces cost.

The invention also relates to a method for gaining sellable petroleum coke pieces out of solidified petroleum coke in a coke drum unit, using the system of any of claims 1 to 11, comprising a water treatment operation with at least one of the first three, and the fourth of the following steps:

- collecting excess amounts of gaseous phase from the slurry basin and feeding the same to the clean water tank by means of a first vent collection line extending from a top portion of the closed slurry basin to the clean water tank, particularly a top portion thereof; and/or
- collecting excess amounts of gaseous phase from the dewatering bin unit and feeding the same to the clean water tank by means of a second vent collection line extending from the dewatering bin unit, particularly a top portion thereof, to the clean water tank, particularly a top portion thereof; and/or
- collecting excess amounts of gaseous phase from the closed drain water basin and feeding the same to the clean water tank by means of a third vent collection line extending from the closed drain water basin, particularly a top portion thereof, to the clean water tank, particularly a top portion thereof; and
- collecting excess amounts of gaseous phase from the clean water tank and feeding the same to a vent treatment unit, in particular to a vent incineration unit, by means of a fourth vent collection line extending from the clean water tank, particularly a top portion thereof, to a vent treatment unit, in particular to a vent incineration unit.

By these vent collection lines it is reliably avoided that gaseous phase/steam containing coke particles gets into the environment. Rather, the gaseous phase/the steam which typically contains coke particles, is collected as indicated and fed to a vent treatment unit (not shown), for example a vent incineration unit.

The coke crushing unit allows for an in-line coke crushing during hydraulic decoking operation, down to a grain size of 100 mm. There is a wide range of crushing capacity. The system and method according to the present invention is able to handle any coke type from sponge to shot coke.

The slurry pump enables a continuous transport of a coke/water mixture from the slurry basin to the dewatering bin unit, especially during hydraulic decoking.

The system and method according to an embodiment of the invention which is not covered by the appended claims enable a full automation and only requires low operation and maintenance cost. They provide for a water recycle system without dispatch to the slurry system, and there is no additional slush handling and no waste water release required.

The water from the water tank can be used for various purposes within the system as well as associated other systems, such as hydraulic cutting and quenching of the solidified petroleum coke, and such as diluting or flushing.

The system of the present invention can further comprise at least one of the following elements/features:

a coke cutting unit configured to cut the solidified petroleum coke out of the coke drum unit;

wherein the coke cutting unit is a water drilling/cutting tool configured to drill a vertical channel into the solidified petroleum coke within the coke drum unit and to cut slices of the solidified petroleum coke within the coke drum unit; and a removal unit, particularly a vibration feeder, configured to remove the sellable petroleum coke pieces from the dewatering bin unit.

wherein the water drilling/cutting tool is operated with water from the water tank.

wherein the coke crushing unit is formed as a respective coke crusher mounted under a respective coke drum of the coke drum unit.

wherein the coke crushers comprise crush rolls with teeth patterns.

wherein the coke crushers are for grinding the coke chunks, cut from the solidified petroleum coke by the coke cutting unit, to sellable petroleum coke pieces of a size enabling pumping of the petroleum coke slurry.

wherein for each pair of coke drum and coke crusher a flexible transition piece is provided to connect the respective coke crusher to the respective coke drum.

wherein the dewatering bins of the dewatering bin unit comprise an upper cylindrical section and a lower conical section, the upper cylindrical section and the upper part of the lower conical section being provided with filtering channels, especially inner screens, and/or the lower part of the lower conical section being provided with a perforation pattern, for removing accumulated water from the dewatering bins.

wherein piping is provided connecting the filtering channels and the perforation pattern to the line leading to the drain water basin.

wherein the number of coke drums corresponds to the number of dewatering bins, and wherein one pair of coke drum and dewatering bin can be connected at a time to the other elements.

In an embodiment, the method can further comprise at least one of the following steps/cycles:

a second drum decoking and dewatering cycle in which the solidified petroleum coke is cut out of the coke drum unit by means of a coke cutting unit, the petroleum coke chunks are crushed into sellable petroleum coke pieces by means of a coke crushing unit, the sellable petroleum coke pieces are lead with the aid of transport water thus forming a petroleum coke slurry to a closed slurry basin through a closed sluice way, the petroleum coke slurry is pumped from the slurry basin to the dewatering bin unit, the sellable petroleum coke pieces collect in the dewatering bin unit and filtered water and petroleum coke fines are led to a drain water basin, separate from the slurry basin;

a third dewatering cycle in which filtered water and petroleum coke fines are led from the dewatering bin unit to the drain water basin, the filtered water and the petroleum coke fines are pumped from the drain water basin to the single water tank where the petroleum coke fines separate from the water and collect in the bottom part thereof, and the petroleum coke fines are led into the dirty water pit; and a fourth removing step, in which the sellable petroleum coke pieces are taken out of the dewatering bin unit.

According to an embodiment of the invention which is not covered by the appended claims, the system comprises the features of original claim 1 without the cooling water line feature, but including the first and at least one of the second and third features of original claim 8, as follows:

Closed, gastight system for gaining sellable petroleum coke pieces out of solidified petroleum coke in a coke drum unit, wherein the system is configured to be connected to a coke drum unit containing solidified petroleum coke and comprises a coke crushing unit for crushing the petroleum coke into sellable petroleum coke pieces, connected to a coke drum unit containing solidified petroleum coke, configured to be connected to the coke drum unit, particularly by means of a flexible transition piece;

a line, particularly a closed sluice way leading petroleum coke slurry to a closed slurry basin;

a closed slurry basin;

a dewatering bin unit configured to receive the petroleum coke slurry from the slurry basin, to collect the sellable petroleum coke pieces, and to act as a filter leading runoff drain water from a lower area thereof as filtered water and petroleum coke fines out of it;

a closed drain water basin, separate from the slurry basin, configured to receive the filtered water and the petroleum coke fines from the dewatering bin unit;

a single water tank configured to receive the filtered water from the drain water basin;

a hot quench water draining line leading from the coke drum to the closed slurry basin;

a drain water discharge line connecting the closed drain water pit to the water tank;

wherein a drain water pump and a centrifugal separation device, in particular a hydrocyclone device, for separating slurry particles out of the drain water from the drain water basin is provided in the drain water discharge line; and/or wherein a dirty water pit, separate from the drain water basin and separate from the slurry basin, is provided, which is configured to receive the slurry particles separated by the centrifugal separation device.

Applicant explicitly reserves to file a divisional application, at a later stage of the procedure, for such feature combination.

This claim can be followed by dependent claims, which are directed to at least one of the following features:

wherein a dirty water supply line is provided, leading from the dirty water pit to the dewatering bin;

wherein a dirty water pump is provided at or in the dirty water pit, or in the dirty water supply line.

wherein the single water tank comprises a sedimentation stage configured to separate solid particles at its bottom portion, particularly at its low point;

wherein a solid particle discharge line is provided connecting the single water tank, particularly its bottom portion to the dirty water pit;

wherein the single water tank is configured a single water tank without a separate second tank;

and which can be additionally directed to the cooling water line feature (last feature of original independent claim 1), and to the features of the original claims 2-7 and 9-11.

The invention relates to a system comprising the features of original claim 1 without the cooling water line feature, but including at least one of the first three, and the fourth of original claim 11, as follows:

Closed, gastight system for gaining sellable petroleum coke pieces out of solidified petroleum coke in a coke drum unit, wherein the system is configured to be connected to a coke drum unit containing solidified petroleum coke and comprises

- a coke crushing unit for crushing the petroleum coke into sellable petroleum coke pieces, connected to a coke drum unit containing solidified petroleum coke, configured to be connected to the coke drum unit, particularly by means of a flexible transition piece;
- a closed sluice way leading petroleum coke slurry to a closed slurry basin;
- a closed slurry basin;
- a dewatering bin unit configured to receive the petroleum coke slurry from the slurry basin, to collect the sellable petroleum coke pieces, and to act as a filter leading runoff drain water from a lower area thereof as filtered water and petroleum coke fines out of it;
- a closed drain water basin, separate from the slurry basin, configured to receive the filtered water and the petroleum coke fines from the dewatering bin unit;
- a single clean water tank configured to receive the filtered water from the drain water basin;
- a hot quench water draining line leading from the coke drum unit to the closed slurry basin
- a first vent collection line extending from a top portion of the closed slurry basin to the clean water tank, particularly a top portion thereof, for collecting excess amounts of gaseous phase from the slurry basin and for feeding the same to the clean water tank; and/or
- a second vent collection line extending from the dewatering bin unit, particularly a top portion thereof, to the clean water tank, particularly a top portion thereof, for collecting excess amounts of gaseous phase from the dewatering bin unit and for feeding the same to the clean water tank; and/or
- a third vent collection line extending from the closed drain water basin, particularly a top portion thereof, to the clean water tank, particularly a top portion thereof, for collecting excess amounts of gaseous phase from the closed drain water basin and for feeding the same to the clean water tank; and
- a fourth vent collection line extending from the water tank, particularly a top portion thereof, to a vent treatment unit, in particular to a vent incineration unit.

The system comprises at least one of the first, the second, and the third vent collection lines and the fourth vent collection line.

This claim is followed by the appended dependent claims, in which dependent claim 3 is additionally directed to the cooling water line feature (last feature of original independent claim 1), and in which the other dependent claims comprise the features of the original claims 2-10.

The invention is further described below by means of an embodiment with reference to the sole FIGURE.

BRIEF DESCRIPTION OF THE DRAWING

The sole FIGURE shows a schematic connection diagram of a closed, gastight system for gaining sellable petroleum coke pieces out of solidified petroleum coke in a coke drum unit, according to an embodiment of the invention.

This system can also be called environmental coke handling operation, or ECHO.

The system ECHO comprises a coke crushing unit C installed underneath and connected to the bottom outlet of the coke drum unit X by means of a transition piece A.

The bottom outlet of the coke crushing unit C is connected by means of a closed sluice way D to a slurry basin E.

A hot quench water draining line 2 extends from the coke drum unit X to the slurry basin E, and a mixing unit B is arranged within this hot quench water draining line 2, particularly downstream of a joining point JP of a cooling water line 3 which will be explained in further detail below.

A slurry line 5 extends from the slurry basin E to a dewatering bin unit G, particularly to a top portion thereof, and a slurry pump F is arranged within this slurry line 5.

The low point of the dewatering bin unit G is connected to a vibration feeder H which in turn leads to a closed coke conveyor and/or to a coke storage unit (not shown).

A drain water supply line 6 attaches to an intermediate level portion of the dewatering bin unit 6 and leads to a drain water basin I.

A drain water discharge line 7 extends between the drain water basin I and a hydrocyclone Q, and a drain water pump K is arranged within this drain water discharge line 7.

A clean water supply line 8 extends from the hydrocyclone Q, particularly from its upper portion to a single water tank L.

A dirty water supply line 9 extends from the hydrocyclone Q, particularly from its bottom portion to a dirty water pit O.

A dirty water pump P is provided within the dirty water pit O, and connects to a dirty water supply line/sludge line 11 that extends from the dirty water pit O to the dewatering bin unit G, particularly to its top portion.

A quench water supply line 1 attaches to the water tank L, particularly to an intermediate level portion thereof and extends to the coke drum unit X. A quench water pump S is arranged within this quench water supply line 1.

A cutting pump water line 14 attaches to the water tank L, particularly to an intermediate level portion thereof, and it also extends to the coke drum unit X, particularly to a top portion thereof (not shown). A cutting pump R is arranged within this cutting pump water line 14.

A make up water supply line 13 is shown to attach to the water tank L at an upper-level portion thereof. This make up water supply line 13 is connected to a water supply (not shown) and comprises a valve V4 by means of which the make up water supply line 13 can be opened or closed or by means of which the amount of make up water flow to the water tank L can be adjusted.

A cooling water line 3 connects to an intermediate level portion of the water tank L and extends to the joining point JP at the hot quench water draining line 2. A transport water pump M and a heat rejection heat exchanger/air cooler N are arranged within this cooling water line 3.

A solid particle discharge line 10 attaches to the low point of the water tank L and leads to the dirty water pit O.

A cooling water backflow line 12 attaches to the cooling water line 3 at a position downstream of the air cooler N and connects to the water tank L, particularly to an intermediate level portion thereof. A valve V2 is arranged within this cooling water back flow line 12 by means of which this line can be opened or closed or the amount of the flow through this line can be adapted.

A valve V1 is arranged within the cooling water line 3, particularly at an end portion thereof, just upstream of the joining point JP. By means of this valve V1, the cooling water line 3 can be opened or closed and/or the amount of the cooling water flow can be adapted to the respective needs.

A flushing line 4 branches off the cooling water line 3, particularly at an end portion thereof and is connected to the sluiceway D, particularly an upper portion thereof. A valve V3 is arranged within this flushing line 4 which enables opening or closing the flushing line 4 and/or adjusting the amount of flushing water flow through this flushing line 4.

A first vent collection line 15*a* connects to a top portion of the closed slurry basin E, and leads to the clean water tank L, particularly a top portion thereof. This first vent collection line 15*a* is configured to collect excess amounts of gaseous phase from the slurry basin E and to feed the same to the clean water tank L.

A second vent collection line 15*b* connects to a top portion of the dewatering bin G and leads to the clean water tank L, particularly a top portion thereof. This second vent collection line 15*b* is configured to collect excess amounts of gaseous phase from the dewatering bin unit G and to feed the same to the clean water tank L.

A third vent collection line 15*c* connects to a top portion of the closed drain water basin I and leads to the clean water tank L, particularly a top portion thereof. This third vent collection line 15*c* is configured to collect excess amounts of gaseous phase from the drain water basin I and to feed the same to the clean water tank L.

In the FIGURE, the first, second, and third vent collection lines 15*a*, 15*b* and 15*c* are formed by the first vent collection line 15*a* leading from the slurry basin E to the clean water tank L and by separate second and third vent collection lines 15*b* and 15*c* joining into this first vent collection line 15*a*, thereby forming a joint collection line 15.

In an alternative embodiment, which is not shown here, the three vent collection lines 15*a*, 15*b* and 15*c* can be formed as a separate vent collection lines leading from this slurry basin E/from the dewatering bin unit G/from the drain water basin E, respectively, to the clean water tank L.

A fourth vent collection line 15*d* connects to the water tank L, particularly a top portion thereof, and leads to a vent treatment unit (not shown), for example a vent incineration unit. This fourth vent collection line 15*d* is configured to collect excess amounts of gaseous phase from the clean water tank L and to feed the same to a vent treatment unit (not shown), for example a vent incineration unit.

By these vent collection lines 15*a*-15*d* it is reliably avoided that gaseous phase/steam containing coke particles gets into the environment. Rather the gaseous phase/the steam which typically contains coke particles, is collected from this slurry basin E/from the dewatering bin unit G/from the drain water basin E and fed to the clean water tank L. From the clean water tank L, the gaseous phase of the water/the steam which typically contains coke particles which collects therein is not released into the environment via one or more vents, which is the case for other systems, but rather is fed to a vent treatment unit (not shown), for example a vent incineration unit.

The operation of the coke drum unit X is normally a cyclic operation of typically 18 to 24 hours of coking followed by a stage called decoking.

During the coking stage, so called petroleum coke is produced and settles as solid agglomerate in the coke drum unit X, while other products of this process leave the coke drum unit X at the top for further treatment. This is continued until the coke drum unit X is filled with solid petroleum coke to a defined level.

In the next stage, namely the decoking stage, this solid/solidified petroleum coke needs to be removed from the coke drum unit X.

During the decoking stage, the agglomerated and solidified petroleum coke is cut by means of high-pressure cutting water taken from the water tank L and supplied to the coke drum unit X through the cutting pump water line 14 and by means of the cutting pump R.

The system ECHO as shown in FIG. 1 is designed to handle the coke as a zero-emission reliable and safe system. The system ECHO is capable to crush petroleum coke, by means of the coke crushing unit C, then route it as slurry, which is to be understood as a mixture of crushed coke particles and water from the coke drum unit X through the transition piece A, through the coke crushing unit C and through the closed sluice way D to the slurry basin E, to the dewatering bin unit G. Finally, sellable coke pieces get from the dewatering bin unit G through the coke discharge to the vibration feeder H and from there to the coke storage area.

The system ECHO as it is described here provides a highly efficient separation of coke from water and produces clean water to be reused in the decoking process.

The system ECHO is typically a batch process which is operated in four process stages, namely:

1. Quench water cooling;
2. Coke crushing and slurry transport;
3. Dewatering; and
4. Dry coke discharge.

1. Quench Water Cooling;

At first, quench water is supplied from the water tank L through the quench water supply line 1 by the operation of the quench water pump S to the coke drum unit X, which is closed at its bottom, until the quench water stands up to 40 meter high in the coke drum unit. The hot solidified petroleum coke in the coke drum unit has typically a temperature of up to 550° C. before the quenching is started. The water cools down the coke and in turn heats up and partially evaporates. The hydrostatic pressure inside the coke drum (height up to 60 m) can lead to a pressure of up to 6 bar, which can result in water temperatures of up to 165° C. without evaporating.

Then, the coke drum unit X is drained through the header (not shown) such that this hot quench water flows into the hot water draining line 2. Cooling water is fed from the water tank L by the operation of the transport water pump M to the joining point JP within the hot water draining line 2. For this purpose, the valve V1 is opened.

The water in the water tank L is typically at a temperature of around 60 to 80° C. By an air cooler N provided in the cooling water line 3, the temperature of the cooling water flow can be reduced to be in the range of around 50 to 70° C.

The mixing unit B provides for a constant flow downstream thereof and can be controlled such that the temperature of the water flow leaving the mixing unit at its downstream end is below 100° C. at atmosphere level, particularly at a temperature of 85-95° C. or less such that the cooled down quench water arriving in the slurry basin E remains liquid and does not evaporate, thereby reliably preventing steam generation within the slurry basin E.

2. Coke Crushing and Slurry Transport,

The operational stage of hydraulic coke drilling/cutting starts with drilling a pilot whole into the solidified petroleum coke (drilling/cutting means are not shown). High pressure water that is supplied through the cutting water line 14 by means of the cutting pump R is used for the drilling step and to cut the coke in the coke drum unit X. The cut coke falls down through the transition piece A and is crushed by the coke crushing unit C down to a particle size of maximum 100 mm. Then, the crushed coke/water mixture flows, through the closed sluice way into the slurry basin E. A highly specialised slurry pump F conveys the mixture of coke and water through the slurry line 5 to the dewatering bin G.

The coke particles in the mixture will be trapped and retained in the coke bed in the dewatering bin unit G, while the drain water drains off from the dewatering bin unit G through the drain water supply line 6 into the drain water basin I. The slurry pump F is configured to be capable of transporting slurry having a coke/water ratio of 1 to 2 without plugging.

The main function of the dewatering bin G is to separate coke from water by a filtering process.

3. Dewatering

During the dewatering stage, a coke bed is formed within the dewatering bin unit G, and coke fines in the slurry are retained by the coke bed, while the clean water drains off into the drain water basin I through the drain water supply line 6. In particular, water drains through filter elements in an upper and lower collection ring attached to the dewatering bin unit G. The dewatering bin unit G is typically equipped with filtration screens, which are uniformly placed along its inner wall.

Once there is enough coke in the dewatering bin unit G to form a filtration bed, the filtrate quality improves, and the drain water flows from the dewatering bin unit G, through the drain water supply line 6 to the drain water basin I, until the end of the dewatering stage.

The lower part of the dewatering bin unit G can be equipped with a conical screen, which is connected with a lower dewatering ring line which can also be called core dewatering line.

The hydraulic head generated between the outlet to the drain water supply line 6 of the dewatering bin unit G and the drain water basin I induces a negative pressure in the core dewatering line which supports the water flow through the voids of coarse coke material.

4. Dry Coke Discharge

Once the coke cutting is completed and the slurry pump F has been stopped, the drain water flow will reduce over time and approach a flow rate of 0 $m^3/h$. When no more water is draining through the drain water supply line 6 the coke can be considered dry and ready for discharge.

In the dry coke discharge stage, the coke product will be discharged from the dewatering bin unit G to the coke conveyor system via a load out vibration feeder H to a conveying system and subsequently to storage facilities of sellable petroleum coke (not shown).

Water Treatment

During all stages, water treatment is conducted continuously as will be explained below.

The drain water from the dewatering bin unit G, especially during the beginning of the dewatering stage, contains a substantial amount of coke fines that need to be removed by further water treatment before being able to reuse the water.

The drain water from the dewatering bin unit G including the coke fines is received in the drain water basin I. From there, the drain water pump K pumps it through the hydrocyclone Q, which is a centrifugal separation device, to the water tank L via the clean water supply line 8. In this hydrocyclone Q coke fines and solids from the drain water are separated and are directed through the dirty water supply line 9 to the dirty water pit O.

From the dirty water pit O, the slush contained therein is pumped by the dirty water pump P and through the slush/dirty water supply line 11 to the dewatering bin unit G, where the coke fines and solids are trapped and retained in the coke filter bed and are effectively removed from the process.

The water that has been filtered/purified by the hydrocyclone Q is received in the water tank L which serves as the water inventory for the process. In the sedimentation stage of the water tank L, the solid particles that are still comprised in the water are collected at its bottom portion, particularly at its low point. This low point is drained through the solid particle discharge line 10 to the dirty water pit O e.g. in regular intervals.

The water from the water tank L can be used as high-pressure cutting water (line 14), as quench water (line 1), or as cooling and transport water (cooling line 3).

For the system ECHO that has been described above with reference to the sole FIGURE, all the above advantageous and embodiments, that have been explained in the general part of the description, apply and they are not repeated here for brevity.

In other embodiments the coke drum unit X comprises two or more sets of a coke drum X, of a transition piece A, of a coke crushing unit C, of a closed sluiceway D and of a hot quench water draining line 2.

In another embodiment, the dewatering bin unit G can comprise two or more dewatering bins G.

LIST OF REFERENCE NUMERALS

ECHO system
X coke drum unit
A transition piece
B mixer
C coke crushing unit
D closed sluice way
E slurry basin
F slurry pump
G dewatering bin unit
H vibration feeder
I drain water basin
K drain water pump
Q hydrocyclone
O dirty water pit
P dirty water pump
L clean water tank
M transport water pump
N air cooler
R cutting pump
S quench water pump
V1, V2, V3, V4 valves
1 quench water supply line
2 hot quench water draining line
JP joining point
3 cooling water line
4 flushing line
5 slurry line
6 drain water supply line
7 drain water discharge line
8 clean water supply line
9 dirty water supply line
10 solid particle discharge line
11 sludge line/dirty water supply line
12 cooling water backflow line
13 make up water supply line
14 cutting pump water line
15, 15*a-d* vent collection lines

The invention claimed is:

1. A closed, gastight system for gaining sellable petroleum coke pieces out of solidified petroleum coke in a coke drum unit, wherein the closed, gastight system is configured to be connected to a coke drum unit (X) containing solidified petroleum coke and comprises a coke crushing unit (C) for crushing the petroleum coke into sellable petroleum coke pieces, configured to be connected to the coke drum unit (X), particularly by means of a flexible transition piece (A);

a closed sluice way (D) leading petroleum coke slurry to a closed slurry basin;

a closed slurry basin (E);

a dewatering bin unit (G) configured to receive the petroleum coke slurry from the closed slurry basin (E), to collect the sellable petroleum coke pieces, and to act as a filter leading runoff drain water from a lower area thereof as filtered water and petroleum coke fines out of it;

a closed drain water basin (I), separate from the slurry basin (E), configured to receive the filtered water and the petroleum coke fines from the dewatering bin unit (G);

a water tank (L) configured to receive the filtered water from the closed drain water basin (I);

a hot quench water draining line (2) configured to receive hot quench water from the coke drum unit (X) and to lead the same to the closed slurry basin (E); and characterised in that the water tank (L) is configured as a single water tank (L) without a separate second tank; and comprises one or more of the following elements:

a first vent collection line (15*a*) extending from a top portion of the closed slurry basin (E) to the clean water tank (L), particularly a top portion thereof, for collecting excess amounts of gaseous phase from the slurry basin (E) and for feeding the same to the clean water tank (L);

a second vent collection line (15*b*) extending from the dewatering bin unit (G), particularly a top portion thereof, to the clean water tank (L), particularly a top portion thereof, for collecting excess amounts of gaseous phase from the dewatering bin unit (G) and for feeding the same to the clean water tank (L); and a third vent collection line (15*c*) extending from the closed drain water basin (I), particularly a top portion thereof, to the clean water tank (L), particularly a top portion thereof, for collecting excess amounts of gaseous phase from the closed drain water basin (I) and for feeding the same to the clean water tank (L); and a fourth vent collection line (15*d*) extending from the water tank (L), particularly a top portion thereof, to a vent treatment unit, in particular to a vent incineration unit.

2. A closed, gastight system according to claim 1, wherein the slurry basin (E) is configured as closed, emission-free slurry basin (E), which does not discharge to the environment; and/or wherein the drain water basin (I) is configured as closed, emission-free drain water basin (I), which does not discharge to the environment.

3. A closed, gastight system according to claim 1, further comprising a cooling water line (3) leading from the water tank (L), including from a intermediate portion thereof, to the hot quench water draining line (2), including to a joining point (JP) in the hot quench water draining line (2) at a position above the closed slurry basin (E), configured to feed cooling water from the water tank (L) to the hot quench water in the hot quench water draining line (2), in order to prevent steam generation within the slurry basin (E).

4. A closed, gastight system according to claim 3, wherein a mixing unit (B), including a static mixer, is provided in the hot quench water draining line (2), including at the position of the joining point (JP) of the cooling water line (3), or at a position downstream of the joining point (JP) of the cooling water line (3), but upstream of the inlet of the closed slurry basin (E).

5. A closed, gastight system according to claim 1, wherein a heat rejection heat exchanger (N) is provided in the cooling water line (3), configured to reduce the temperature of the cooling water flowing through the cooling water line (3), against a secondary heat exchange medium, including environmental air.

6. A closed, gastight system according to claim 1, wherein a transport water pump (M) is provided in the cooling water line (3), including at a position upstream of the heat rejection heat exchanger (N).

7. A closed, gastight system according to claim 1, further comprising a quench water line (1) leading from the single water tank (L) to the coke drum unit (X), for filling the coke drum unit (X) with water, thereby hardening and cooling the solidified petroleum coke; and/or wherein a quench water pump(S) is provided in the quench water line (1).

8. A closed, gastight system (2) according to claim 1, further comprising a control unit, wherein, during operation of the closed, gastight system, the solidified petroleum coke is at a temperature of up to 550° C., and the water in the single water tank (L) and flowing into the cooling water line (3) is at a temperature of 60 to 80° C.;

wherein the control unit is configured to supply quench water to the coke drum unit (X) through the quench water line, in which the water stands up to 60 m high, such that the water heats up to a temperature of up to 165° C. within the coke drum unit (X) and has a pressure level of up to 6 bar, without evaporating;

wherein the control unit is further configured to operate the transport water pump (M) and the heat rejection heat exchanger (N) such that a cooling water flow mixes with the hot water in the hot quench water draining line (2), such that the temperature of the hot drain water is reduced to a temperature of around 85-95° C. before reaching the slurry basin I;

wherein the control unit is further configured to operate the heat rejection heat exchanger (N) in the cooling water line (3), such that the temperature of the cooling water flowing through the cooling water line (3) is cooled against a secondary heat exchange medium, including environmental air, to a temperature of around 50 to 70° C.

9. A closed, gastight system according to claim 1, wherein a drain water discharge line (7) is provided connecting the closed drain water basin (I) to the water tank (L);

wherein a drain water pump (P) and a centrifugal separation device, including a hydro cyclone device (Q), for separating slurry particles out of the drain water from the drain water basin (I) is provided in the drain water discharge line (7); and/or wherein a dirty water pit (O), separate from the drain water basin (I) and separate from the slurry basin I, is provided, which is configured to receive the slurry particles separated by the centrifugal separation device (Q); and/or wherein a dirty water supply line/sludge line (11) is provided, leading from the dirty water pit (O) to the dewatering bin unit (G); and/or wherein a dirty water pump (P) is provided at or in the dirty water pit (O), or in the dirty water supply line (11).

10. A closed, gastight system according to claim 9, wherein the single water tank (L) comprises a sedimentation stage configured to separate solid particles at its bottom portion, including at its low point; and/or wherein a solid particle discharge line (10) is provided connecting the single water tank (L), including its bottom portion to the dirty water pit (O); and/or wherein the single water tank (L) is configured a single water tank (L) without a separate second tank.

11. A closed, gastight system according to claim 1, further comprising at least one of the following elements:

a slurry line (5) connecting the slurry basin I to the dewatering bin unit (G), including to a top portion thereof, for pumping petroleum coke slurry to the dewatering bin unit (G); and/or wherein a slurry pump (F) is provided in the slurry line (5); and a flushing line (4) branching off from the cooling water line (3) and leading to the sluice way (D), for supporting flushing and pumping of the petroleum coke slurry to the slurry basin I; and/or wherein a valve (V3) is provided in this flushing line (4).

12. A method for gaining sellable petroleum coke pieces out of solidified petroleum coke in a coke drum unit (X), using the closed, gastight system of claim 3, comprising the steps of in a quenching and quench water cooling operation, flooding the coke drum unit (X), by means of a quench water supply line (1) leading from a single water tank (L) to the coke drum unit (X), and draining the hot quench water to a slurry basin I via a hot quench water line (2), thereby hardening and cooling the solidified petroleum coke;

wherein a cooling water flow is fed from a water tank (L), including from a bottom portion thereof, through a cooling water line (3) to the hot quench water draining line (2), including to a joining point (JP) in the hot quench water draining line (2) at a position above the slurry basin I, in order to cool the hot water in the hot quench water draining line (2), in order to prevent steam generation within the slurry basin I.

13. A method of claim 12, wherein, during operation of the closed, gastight system, the water in the single water tank (L) and flowing into the cooling water line (3) is at a temperature of around 70° C.;

wherein, during beginning of the quenching and quench water cooling operation, the solidified petroleum coke is at a temperature of up to 550° C., wherein, in the flooding step, quench water is supplied to the coke drum unit (X) through the quench water line (1), which stands up to 60 m high within the coke drum unit, such that the water heats up in the coke drum unit (X) to a temperature of up to 165° C., and has a pressure level of up to 6 bar, without evaporating;

wherein, in the draining step, the transport water pump (M) and, including also the heat rejection heat exchanger (N) is/are operated such that the cooling water flow mixes with the hot water in the hot quench water draining line (2), such that the temperature of the hot drain water is reduced to a temperature of around 85-95° C. in the hot quench water draining line (2) before reaching the slurry basin I; and/or wherein in the draining step, the heat rejection heat exchanger (N) in the cooling water line (3) is operated, such that the temperature of the cooling water flowing through the cooling water line (3) is cooled against a secondary heat exchange medium, including environmental air, to a temperature of around 50 to 70° C.

14. A method for gaining sellable petroleum coke pieces out of solidified petroleum coke in a coke drum unit (X), using the closed, gastight system of claim 9, comprising a water treatment operation comprising leading drain water from the closed drain water basin (I) to the water tank (L) through a drain water discharge line (7) connecting the closed drain water basin (I) to the single water tank (L), including to an upper portion thereof, and using a drain water pump (P);

separating slurry particles out of the drain water from the drain water basin (I) using a centrifugal separation device, including a hydro cyclone device (Q), in the drain water discharge line (7);

receiving the slurry particles separated by the centrifugal separation device (Q) in a dirty water pit (O), separate from the drain water basin (I) and separate from the slurry basin I;

leading dirty water from the dirty water pit (O) to the dewatering bin unit (G), through a dirty water supply line (11), using a dirty water pump (P) provided at or in the dirty water pit (O), or in the dirty water supply line (11);

separating solid particles at the bottom portion at the low point of the single water tank (L); and draining the solid particles from the bottom portion, including the low point of the single water tank (L), through a solid particle discharge line (10) to the dirty water pit (O), wherein the solid particle discharge line (10) connects the single water tank (L), including its bottom portion to the dirty water pit (O).

15. A method for gaining sellable petroleum coke pieces out of solidified petroleum coke in a coke drum unit (X), using the closed, gastight system of claim 1, comprising a water treatment operation comprising at least one of the first three, and the fourth of the following steps:

collecting excess amounts of gaseous phase from the slurry basin I and feeding the same to the clean water tank (L) by means of a first vent collection line (15*a*) extending from a top portion of the closed slurry basin I to the clean water tank (L), including a top portion thereof; and/or collecting excess amounts of gaseous phase from the dewatering bin unit (G) and feeding the same to the clean water tank (L) by means of a second vent collection line (15*b*) extending from the dewatering bin unit (G), including a top portion thereof, to the clean water tank (L), including a top portion thereof; and/or collecting excess amounts of gaseous phase from the closed drain water basin (I) and feeding the same to the clean water tank (L) by means of a third vent collection line (15*c*) extending from the closed drain water basin (I), including a top portion thereof, to the clean water tank (L), including a top portion thereof; and collecting excess amounts of gaseous phase from the clean water tank (L) and feeding the same to a vent treatment unit, including to a vent incineration unit, by means of a fourth vent collection line (15*d*) extending from the clean water tank (L), including a top portion thereof, to a vent treatment unit, including to a vent incineration unit.

16. A closed, gastight system according to claim 2, further comprising a cooling water line (3) leading from the water tank (L), including from a intermediate portion thereof, to the hot quench water draining line (2), including to a joining point (JP) in the hot quench water draining line (2) at a position above the closed slurry basin (E), configured to feed cooling water from the water tank (L) to the hot quench water in the hot quench water draining line (2), in order to prevent steam generation within the slurry basin (E).

17. A closed, gastight system according to claim 2, wherein a heat rejection heat exchanger (N) is provided in the cooling water line (3), configured to reduce the temperature of the cooling water flowing through the cooling water line (3), against a secondary heat exchange medium, including environmental air.

18. A closed, gastight system according to claim 2, wherein a transport water pump (M) is provided in the cooling water line (3), including at a position upstream of the heat rejection heat exchanger (N).

19. A closed, gastight system according to claim 2, further comprising a quench water line (1) leading from the single water tank (L) to the coke drum unit (X), for filling the coke drum unit (X) with water, thereby hardening and cooling the solidified petroleum coke; and/or wherein a quench water pump(S) is provided in the quench water line (1).

20. A closed, gastight system (2) according to claim 2, further comprising a control unit, wherein, during operation of the closed, gastight system, the solidified petroleum coke is at a temperature of up to 550° C., and the water in the single water tank (L) and flowing into the cooling water line (3) is at a temperature of 60 to 80° C.;

wherein the control unit is configured to supply quench water to the coke drum unit (X) through the quench water line, in which the water stands up to 60 m high, such that the water heats up to a temperature of up to 165° C. within the coke drum unit (X) and has a pressure level of up to 6 bar, without evaporating;

wherein the control unit is further configured to operate the transport water pump (M) and the heat rejection heat exchanger (N) such that a cooling water flow mixes with the hot water in the hot quench water draining line (2), such that the temperature of the hot drain water is reduced to a temperature of around 85-95° C. before reaching the slurry basin I;

wherein the control unit is further configured to operate the heat rejection heat exchanger (N) in the cooling water line (3), such that the temperature of the cooling water flowing through the cooling water line (3) is cooled against a secondary heat exchange medium, including environmental air, to a temperature of around 50 to 70° C.

* * * * *